US006196404B1

(12) United States Patent
Chen

(10) Patent No.: US 6,196,404 B1
(45) Date of Patent: Mar. 6, 2001

(54) TRIPLE SEAL CONTAINER WITH PROTRUSION

(75) Inventor: Jeffrey Chen, Staten Island, NY (US)

(73) Assignee: Newspring Industrial Corp., East Newark, NJ (US)

( * ) Notice: Subject to any disclaimer, the term of this patent is extended or adjusted under 35 U.S.C. 154(b) by 0 days.

(21) Appl. No.: 09/483,350

(22) Filed: Jan. 14, 2000

Related U.S. Application Data

(63) Continuation-in-part of application No. 09/120,985, filed on Jul. 22, 1998, which is a continuation-in-part of application No. 29/066,299, filed on Feb. 11, 1997, now Pat. No. Des. 415,420, and a continuation-in-part of application No. 29/081,160, filed on Dec. 23, 1997.

(51) Int. Cl.[7] ..... B65D 41/16

(52) U.S. Cl. ..... 220/4.21; 220/780; 220/781; 220/792; 206/505

(58) Field of Search ..... 220/4.21, 4.24, 220/780, 781, 782, 783, 790, 792, 796, 797, 798, 801, 802, 305; 206/503, 508, 505, 515, 519

(56) References Cited

U.S. PATENT DOCUMENTS

| | | | | |
|---|---|---|---|---|
| 2,798,631 | * | 7/1957 | Engel | 220/266 X |
| 4,124,141 | * | 11/1978 | Armentrout et al. | 220/783 |
| 4,555,043 | * | 11/1985 | Bernhardt | 220/783 |
| 4,844,263 | * | 7/1989 | Hadtke | 206/508 |
| 5,377,860 | * | 1/1995 | Littlejohn et al. | 220/780 |
| 5,553,701 | * | 9/1996 | Jarecki et al. | 220/780 X |
| 5,758,791 | * | 6/1998 | Mangla | 220/780 X |
| 6,056,138 | * | 5/2000 | Chen | 220/4.21 |

* cited by examiner

*Primary Examiner*—Nathan J. Newhouse
(74) *Attorney, Agent, or Firm*—Gibbons, Del Deo, Dolan, Griffinger & Vecchione

(57) ABSTRACT

The present invention is a container for food. The container has a lid and a base which form a series of three self-reinforcing seals when mated. A protrusion on the lid reinforces the triple seal formed between the lid and base. The protrusion applies a force to the base, locking the lid and base together. The third seal has the largest surface area and acts as a first line of defense against food leakage out of the container and a last line of defense against the entry of contaminants into the container.

9 Claims, 6 Drawing Sheets

TRIPLE SEAL CONTAINER WITH PROTRUSION

RELATED APPLICATIONS

The present patent application is a continuation-in-part of U.S. patent application Ser. No. 09/120,985 (NIC-3) filed Jul. 22, 1998 and now pending in the United States Patent and Trademark Office, which is a continuation-in-part of U.S. patent application Ser. No. 29/066,299 (NIC-1) filed Feb. 11, 1997 now U.S. Pat. No. D 415,420 and U.S. patent application Ser. No. 29/081,160 (NIC-2) filed Dec. 23, 1997. The applications have common inventors and assignees and are incorporated herein by reference.

FIELD OF THE INVENTION

This invention generally relates to containers for storing and transporting food, and in particular to a sealing component formed between a base and a rim of a container for storing food.

BACKGROUND OF THE INVENTION

There are various container assemblies currently used in the "take-out" food industry which are capable of transporting and storing food for a temporary period. It is important that such containers may be sealed to prevent the leakage and/or spoilage of food while in transport or storage. Currently, there are various designs available for such a purpose in the food industry.

An example of such a container consists of a lid and base portion that, upon mating form a seal to prevent leakage and spoilage. These containers are made of various materials including an aluminum base having a cardboard lid and a plastic base with a plastic lid. Specifically, an aluminum base forms a seal with the lid by the folding of the base around the peripheral to grasp the lid. This seal is not effective at preventing the food from leaking out of the container through the seal, especially when liquid is contained within the container. In addition, such containers are inconvenient because the assembly and disassembly proves to be both time consuming and messy.

Containers which consist of a base and lid made of plastic typically have only one or two seals to prevent the flow of food out of the container area and to prevent the introduction of bacteria and air into the container. With such containers, however, food leakage can occur when one or both seals are broken. Typical double seal containers provide two identical seals, one interior to the other. The seals have small surface areas to prevent the flow of food, liquids and/or air. Disadvantageously, the small surface area of the seals results in failure of the seal more often than acceptable. In addition, double seal containers typically have the two seals located right next to each other, so that if food has leaked through one seal, it is highly likely that the food will leak through the other. In other words, the placement of the seals on the currently available containers does not allow the seals to reinforce each other because they are close in proximity.

There are also available certain containers having three seals. Again, as with the double and single seal containers, the surface area of the seals is small and the proximity of the seals is close. Therefore, the likelihood of failure of theses seals is great.

Yet another example of a container currently available in the "take-out" food industry are the traditional Chinese Food take-out containers. These containers are made completely of cardboard. These containers form a seal on top by the folding over of interlocking flaps. This seal is not airtight and thus, leakage is a common occurrence. In addition, food often leaks out of the bottom of such containers because the bottom is composed of one piece of cardboard folded to form the container. Thus, there are gaps in the container, along the folds. In addition, the cardboard of the container weakens easily and is not effective for storing food that may be left over.

Considering the great number of containers in use in the take-out industry, there is a need for a container having a seal which prevents food leakage and spoilage. In addition, there is a need for a container which may be easily and readily assembled and disassembled. In addition, the container must be of such quality such that it is capable of storing foods for some length of time. Yet another desirable feature is for a container that may be easily and compactly stored.

SUMMARY OF THE INVENTION

The present invention is a triple seal container having a protrusion on the lid which reinforces the triple seal formed between the lid and base. The invention uses a series of three self-reinforcing seals. The protrusion applies a force to the base, locking the lid and base together. The third seal has the largest surface area and acts as a first line of defense against food leakage out of the container and a last line of defense against the entry of contaminants into the container.

The present invention overcomes the disadvantages of the prior art because it is easily assembled and disassembled while having a triple seal reinforced by the protrusion. In addition, such a triple seal is excellent for protecting food while in transport and storing such food in the container for a long period of time. The invention also provides for an area for easy grasping of the container without burning the user's fingers, if the contents of the container are hot.

In an exemplary embodiment of the present invention, the container comprises a base and a lid which, when mated, form three seals, two of which are reinforced by the protrusion. The interior seal has a surface area larger than the middle and exterior seals. The protrusion is located on the lid and urges the base to contact with the lid at such a point, resulting in the reinforcement of the middle and exterior seals.

Advantageously, the use of three seals and a protrusion on the container does not preclude easy assembly of the lid and base. The ability to break the seal, and remove or introduce food to the container, then close all three seals is easily accomplished with the present invention through the application of a small force. The closure involves no more than simple pressure on the lid and the sealing of the exterior or middle seal ensures the closure of the remaining seals.

The container of the present invention are same size stackable, with one base fitting into the base of the next container, and the lids acting in the same fashion. The invention is stackable when in the fully assembled position as well. This dramatically reduces the storage space required to keep large quantities of the invention. The present invention is, therefore, a safe, easy to use container that can be used in the food preparation and distribution industries and in the private home.

BRIEF DESCRIPTION OF THE DRAWINGS

For a detailed understanding of the present invention, reference should be made to the following detailed description taken in conjunction with the accompanying drawings wherein.

DETAILED DESCRIPTION

Figure 1:
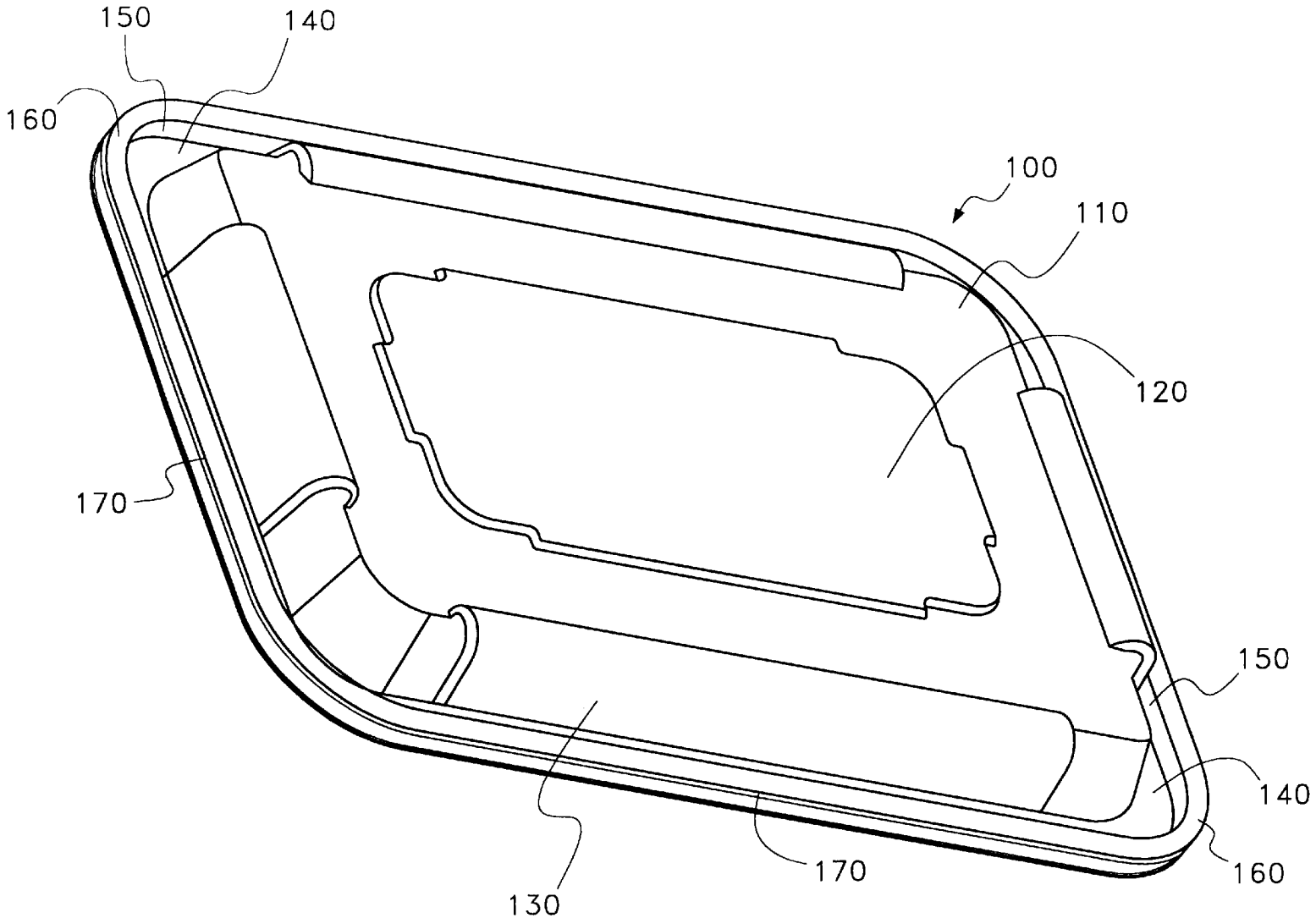
FIG. 1 is a perspective view of the lid.
Figure 2:
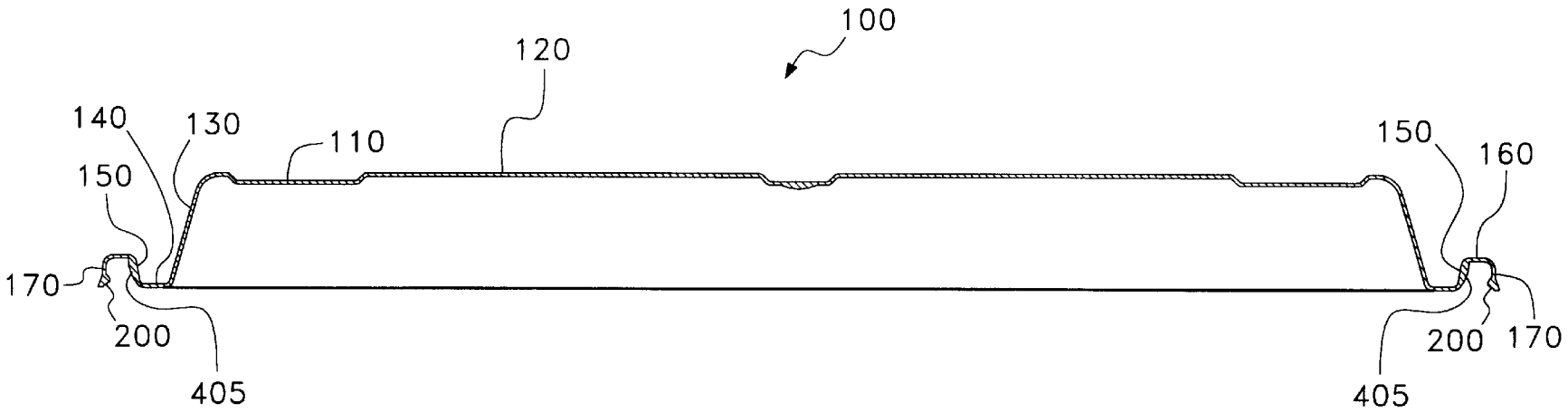
FIG. 2 is a side view of the lid.

FIGS. 1 and 2 show a lid 100 having a substantially planar top portion 110 with a slightly raised, substantially planar region 120 parallel to a top portion 110. A peripheral wall 130 extends substantially vertically downward from the top portion 110. A rim 140 extends substantially horizontally from the peripheral wall 130. An inner edge 150 extends generally perpendicularly upwards from the rim 140. A protrusion 405 (FIG. 4) is attached to the inner edge 150. A middle sealing edge 160 is connected substantially perpendicularly to the inner edge 150. From the middle sealing edge 160, an exterior sealing edge 170 stretches generally downwards. A locking lip 200 protrudes from the exterior sealing edge 170.

Figure 3:
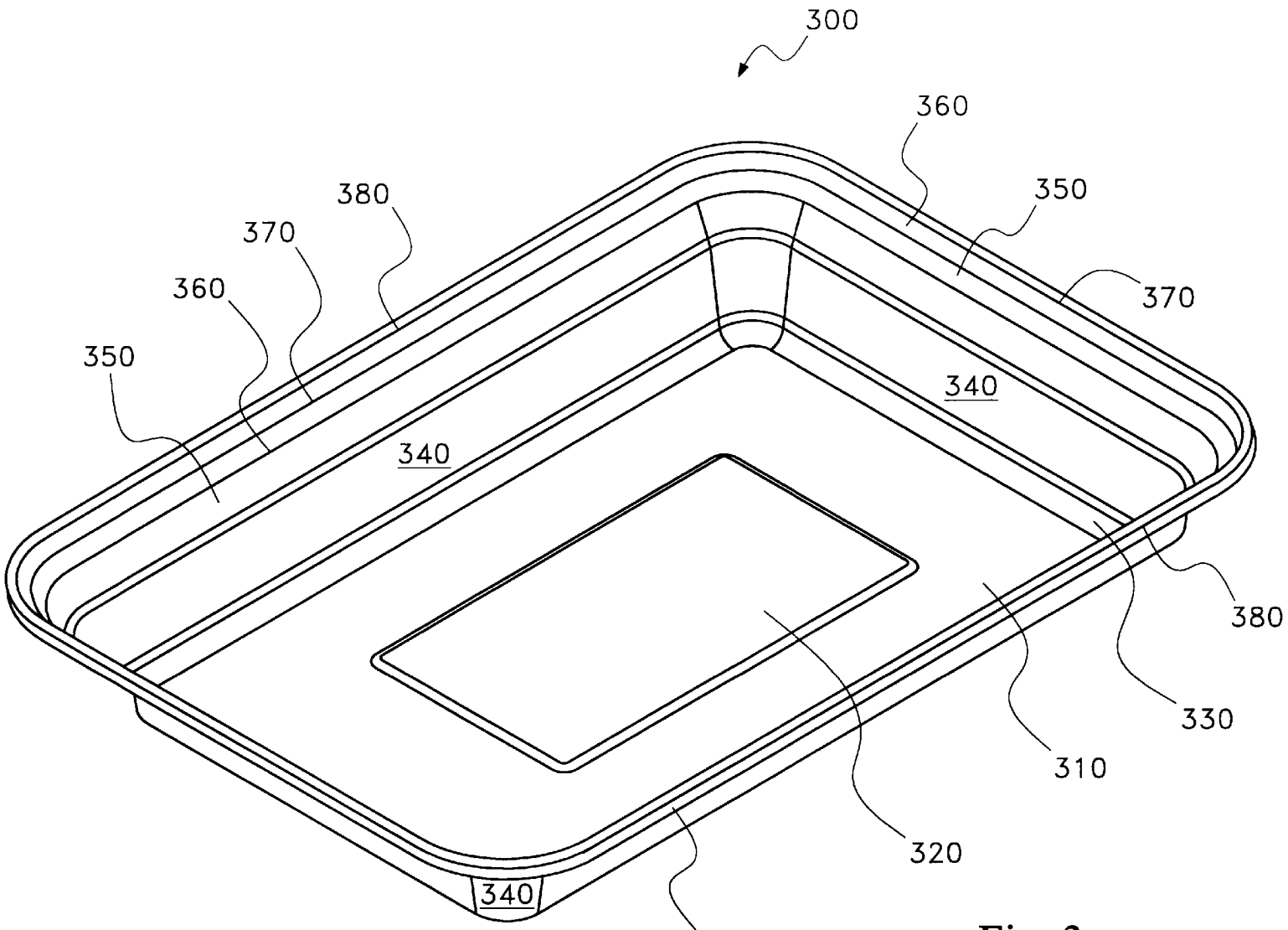
FIG. 3 is a perspective view of the base.

Referring now to FIG. 3, a base 300 is illustrated having a substantially planar bottom portion 310, including a slightly raised, substantially planar region 320, that is parallel to bottom portion 310. Connected to the bottom portion 310, is a convex extension surface 330, which runs along the perimeter of base 300. From convex extension surface 330, a perimeter wall 340 extends substantially vertically upwards. The perimeter wall 340 ends in a generally horizontally extending rim 350. Rim 350 is integrally connected to a generally perpendicular upwardly extending inner edge 360. A middle sealing edge 370 extends substantially horizontally from the inner edge 360 and an exterior sealing edge 380 extends substantially vertically downwards from the middle sealing edge 370.

Figure 4:
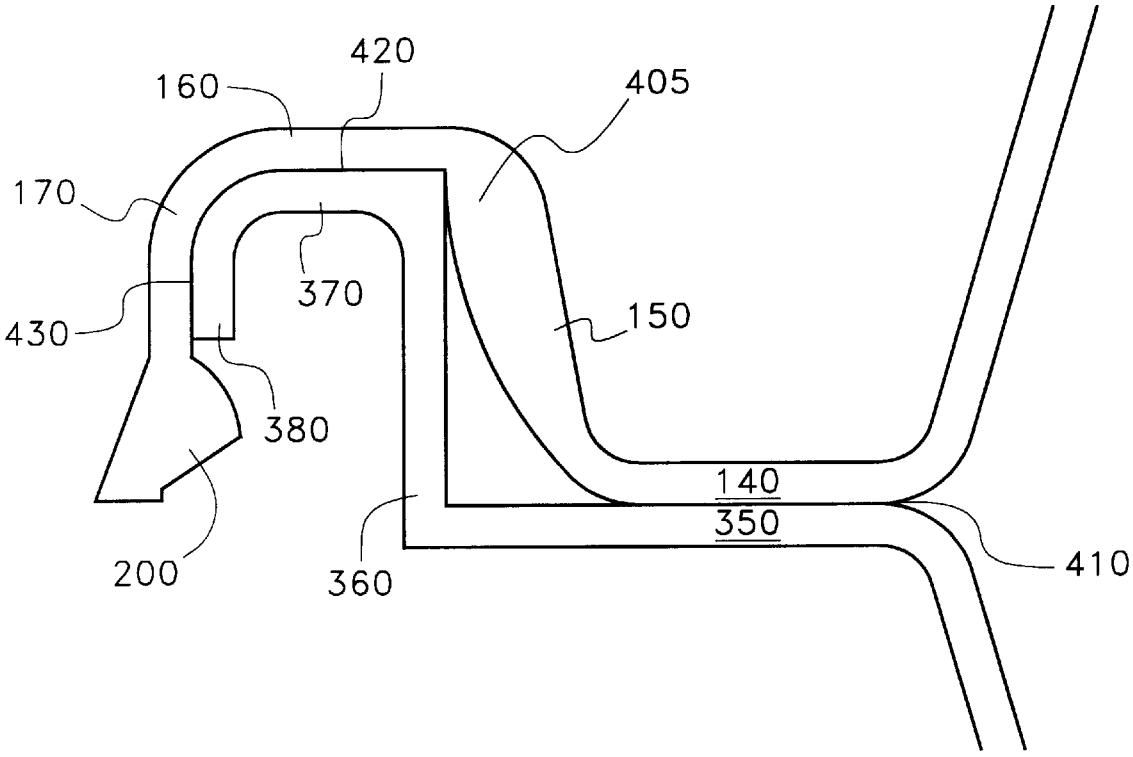
FIG. 4 is an enlarged view of the seals between the lid and the base.
Figure 5:
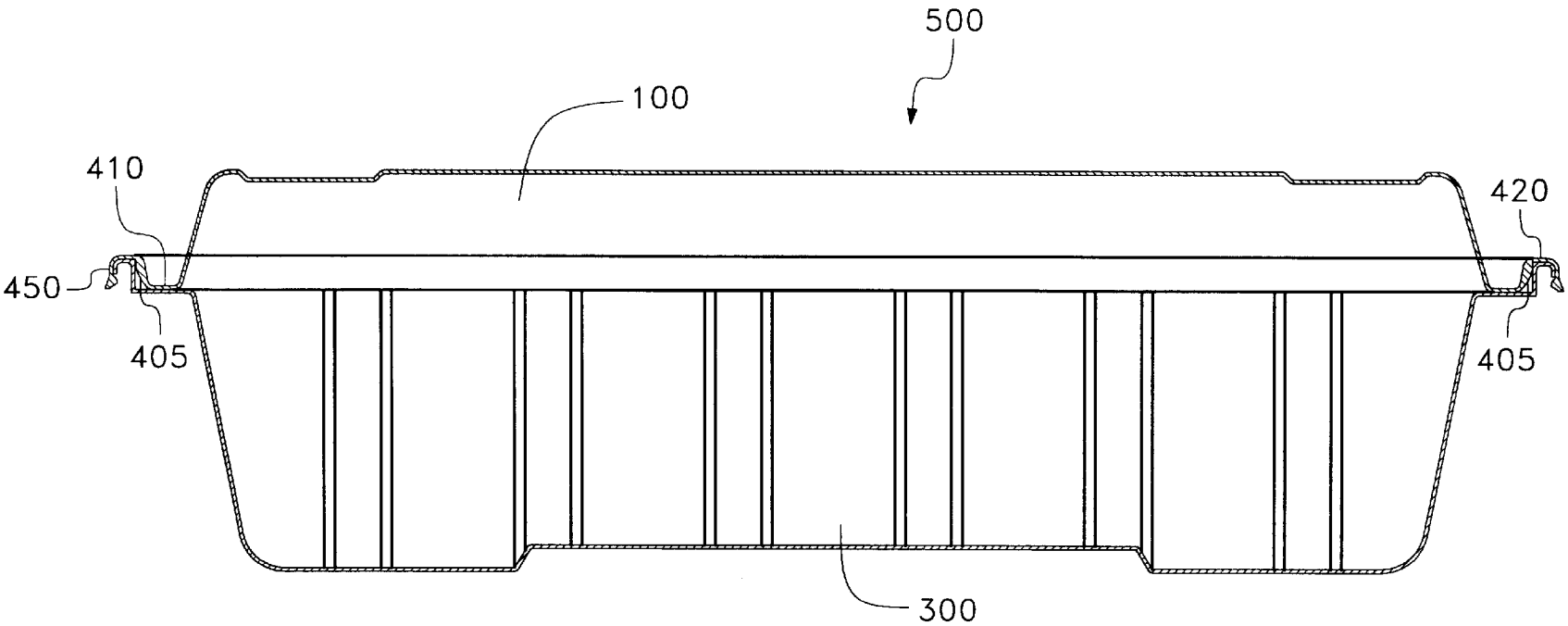
FIG. 5 is a side view of the fully assembled container including a base and a lid.

Given the above structure, the interaction between the various lid and base components are now described with respect to FIGS. 4 and 5. FIG. 4 shows an enlarged view of the three seals and FIG. 5 shows a fully assembled container 500. This interaction creates the triple seal formation of the present invention.

Lid 100 is pressed in a downward motion onto base 300. Lid 100 and base 300 are aligned by inner edge 150 and protrusion 405, with locking lip 200 contacting downwardly exterior base sealing edge 380.

Upon the application of downward pressure on the lid 100, locking lip 200 flexes exterior sealing edge 170 outwards. Further downward pressure on the lid 100 pushes the locking lip 200 past the end of base exterior sealing edge 380. Locking lip 200 then moves inwardly with lid exterior sealing edge 170 flexing inwardly to contact exterior base sealing edge 380. Upon the mating of the lid 100 and base 300, a container as shown in FIGS. 4 and 5 is assembled.

In the fully assembled container 500, an interior seal 410 is formed between lid rim 140 and base rim 350, a middle seal 420 is formed between lid middle sealing edge 160 and base middle sealing edge 370, and an exterior seal 430 is formed between lid exterior sealing edge 170 and base exterior sealing edge 380. Upon this mating of the lid 100 and the base 300, the protrusion 405 applies a force to the base inner edge 360. This force, in turn, pushes the base middle sealing edge 370 against the lid middle sealing edge 160, reinforcing the middle seal and pushes the base exterior sealing edge 380 against the lid exterior sealing edge 170 reinforcing the exterior seal. In addition, the seals are self-reinforcing because the engagement of any one of the three seals, will urge the engagement of the two remaining seals. Although the container 500 is rectangular in configuration, it may be any variety of shapes, for example, round, square, oval, or oblong.

In addition to acting as seals, the interior seal 410, middle seal 420 and exterior seal 430 are conveniently located on the container 500 so that this area, as a whole may be grasped to carry the container. This proves especially helpful when the contents of the container 500 are hot or when the container 500 is removed from the microwave.

In the exemplary embodiment of the invention, the interior seal 410 is larger than either the exterior seal 430 or the middle seal 420. With the increased surface area, this interior seal 410 acts as a larger first barrier against leakage from the container 500, and a superior final barrier against bacterium and contamination.

Figure 6:
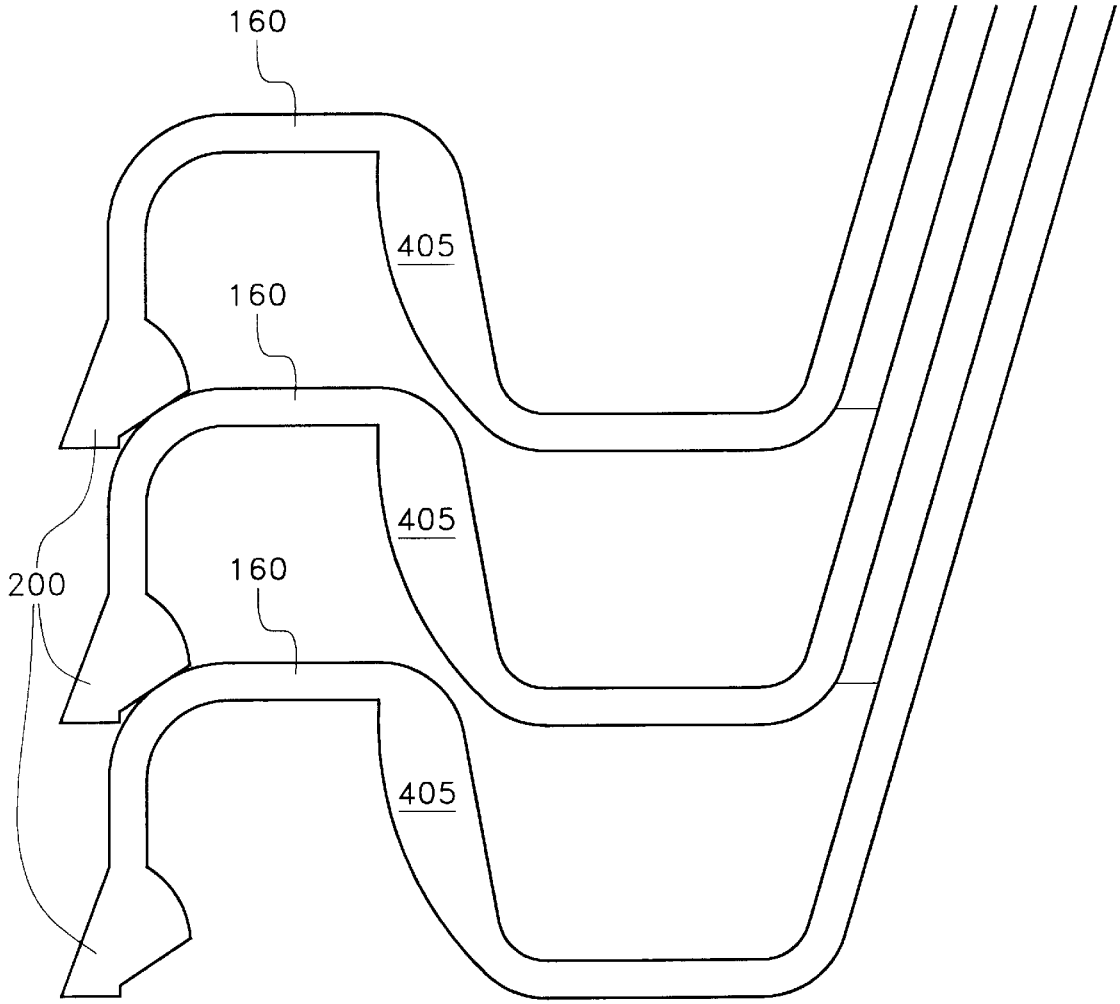
FIG. 6 is an enlarged view of three lids, stacked one on top of the next.

Referring now to FIGS. 1 and 6, it can be seen that the lids 100, and bases 300, can be easily stacked in nested columns, lid upon lid and base upon base. The lids 100 are stackable since the locking lip 200 rests directly upon the middle sealing edge 160 of the next lid. The bases are also stackable since the planar bottom portion 310 of one base rests upon the planar bottom portion 310 of the next base. In addition, base rim 350 provides support for the next base rim 350. The stackability of the lids and bases provides a minimal stacking height and minimizes the required storage area. In addition, the top portion 110 and the substantially planar region 120 of the lid 100 is fitted with the bottom portion 320 and the substantially planar region 320 of the base 300 so that the fully assembled container 500 may be stacked securely one on top of the other.

In an alternative embodiment of the present invention, the container may take on an oval, or circular configuration. The critical components of both the lid 100 and base 300 remain substantially identical to those described herein.

While the invention has been described with reference to preferred embodiments, it should be appreciated by those skilled in the art that the invention may be practiced, otherwise than as specifically described herein without departing from the scope of the invention. It is, therefore, to be understood that the scope of the invention be limited only by the appended.

What is claimed is:

1. A container having three seals, comprising:

a base having a substantially planar bottom, a base perimeter wall extending substantially vertically upward from said bottom, a base rim extending substantially horizontally outward from said base perimeter wall, and a base sealing edge attached to said base rim; and a lid having to a substantially planar top, a lid perimeter wall extending substantially vertically downward from said top, a lid rim extending substantially horizontally outward from said lid perimeter wall, a lid sealing edge attached to said lid rim, a protrusion attached to said lid sealing edge, and a locking lip protruding from said sealing edge;

wherein said base sealing edge and said lid sealing edge are molded to be correspondingly mateable to each other and upon mating said base sealing edge and said lid sealing edge form a middle seal and an exterior seal and said base rim and said lid rim form an interior seal and further wherein said protrusion pushes said base sealing edge against said lid sealing edge.

2. The container according to claim 1, wherein said interior seal has a surface area greater than said middle seal and said exterior seal.

3. The container according to claim 1, wherein said interior seal has a surface area two times greater than the surface area of said middle seal and three times greater than the surface area of said exterior seal.

4. The container according to claim 1, wherein at least a second base is stackable within said base.

5. The container according to claim 1, wherein at least a second lid is stackable within said lid.

6. The container according to claim 1, wherein at least a second container is stackable on said container.

7. The container according to claim 1, said base sealing edge further comprising:

an inner base edge extending generally vertically upward from said base rim;

a middle base sealing edge extending substantially horizontally outward from said inner base edge; and an exterior base sealing edge extending substantially vertically downward from said middle base sealing edge; and said lid sealing edge further comprising:

an inner lid edge extending generally vertically upward from said lid rim, wherein said protrusion is attached to said inner lid edge;

a middle lid sealing edge extending substantially horizontally outward from said inner lid edge; and an exterior lid sealing edge extending substantially vertically downward from said middle lid sealing edge, said locking lip protruding from said downward exterior lid sealing edge;

wherein upon mating of said bottom and said lid, said protrusion pushes said inner base edge outwards so that said base rim and said lid rim form said interior seal and said middle base sealing edge and said middle lid sealing edge form said middle seal and said exterior base sealing edge and said exterior lip sealing edge form said exterior seal.

8. The container according to claim 7, wherein the engagement of one of said exterior seal, said middle seal or said interior seal urges the engagement of the other two remaining seals.

9. The container having three seals, comprising:

a base having a substantially planar bottom, a base perimeter wall extending substantially vertically upward from said bottom, a base rim extending substantially horizontally from said base perimeter wall, and a base sealing edge having an inner base edge extending generally vertically from said base rim, a middle base sealing edge extending substantially horizontally from said inner base edge, and an exterior base sealing edge extending substantially vertically from said middle base sealing edge;

a lid having a substantially planar top, a lid perimeter wall extending substantially vertically downward from said top, a lid rim extending substantially horizontally from said lid perimeter wall, and a lid sealing edge having an inner lid edge extending generally vertically from said lid rim, a protrusion attached to said inner lid edge, a middle lid sealing edge extending substantially horizontally from said inner lid edge, and an exterior lid sealing edge extending substantially vertically from said middle lid sealing edge, and a locking lip protruding from said exterior lid sealing edge;

wherein, said base sealing edge and said lid sealing edge are molded to be correspondingly mateable to each other and upon mating of said base and said lid, said base rim and said lid rim form said interior seal, said middle base sealing edge and said middle lid sealing edge form said middle seal and said exterior base sealing edge and said exterior lip sealing edge form said exterior seal, and wherein, the engagement of one of said exterior seal, said middle seal and said interior seal urges the engagement of the other two remaining seals, and said interior seal has a surface area greater than said middle seal and said exterior seal.

* * * * *